US008373096B2

(12) United States Patent
Tsai et al.

(10) Patent No.: US 8,373,096 B2
(45) Date of Patent: Feb. 12, 2013

(54) TOILET SEAT HEATING DEVICE

(76) Inventors: I-Shou Tsai, Longjing Township, Taichung County (TW); Lin-Ho Liu, Zhuqi Township, Chiayi County (TW)

( * ) Notice: Subject to any disclaimer, the term of this patent is extended or adjusted under 35 U.S.C. 154(b) by 343 days.

(21) Appl. No.: 12/759,447

(22) Filed: Apr. 13, 2010

(65) Prior Publication Data

US 2011/0248015 A1 Oct. 13, 2011

(51) Int. Cl.
*A47K 13/30* (2006.01)

(52) U.S. Cl. ..... 219/217

(58) Field of Classification Search ..... 219/217, 219/219

See application file for complete search history.

(56) References Cited

U.S. PATENT DOCUMENTS 4,256,178 A * 3/1981 Fauvel ..... 165/165
2005/0229301 A1* 10/2005 Hassan ..... 4/420.4

FOREIGN PATENT DOCUMENTS

JP 08-289858 * 5/1996
JP 11299700 A * 11/1999

* cited by examiner

*Primary Examiner* — Howard Weiss
*Assistant Examiner* — Sue Tang
(74) *Attorney, Agent, or Firm* — Muncy, Geissler, Olds & Lowe, PLLC

(57) ABSTRACT

A toilet seat heating device is installed between a toilet cover and a bowl to provide a warming function when people use the toilet. The toilet seat heating device includes a base plate which is provided with a carbon fiber on the hotline, an upper seat and a cooling fin which is provided between the base plate and the upper seat. An upper side of the base plate is provided with an annular groove into which the carbon fiber on the hotline is provided to contact with the cooling fin. When the carbon fiber on the hotline is energized, the cooling fin can quickly absorb heat energy of the carbon fiber on the hotline and then conduct the heat energy upward to the upper seat, thereby providing a warm and comfortable toilet seat.

8 Claims, 5 Drawing Sheets

TOILET SEAT HEATING DEVICE

BACKGROUND OF THE INVENTION a) Field of the Invention

The present invention relates to a toilet seat heating device and more particularly to a toilet seat heating device, wherein an upper surface of a base plate, which is provided with a carbon fiber on the hotline, is orderly assembled with a cooling fin and an upper seat, such that the cooling fin can quickly absorb heat energy of the carbon fiber on the hotline and then conduct the heat energy upward to the upper seat when the carbon fiber on the hotline is energized, thereby providing a warming effect.

b) Description of the Prior Art

A toilet used now is primarily constituted by a bowl and a water tank. As being primarily a ceramic product, the bowl will provide an ice cold feeling. Therefore, an upper side of the bowl will be usually added with a plastic toilet seat to overcome the ice cold problem. However, when air temperature drops, the plastic toilet seat is still rather cold. Thus, there are vendors who use a water heating pipe to allow temperature of the toilet seat to close to that of a human body, such that people can be more comfortable when using the toilet. FIG. 1 shows a conventional toilet seat A. The toilet seat A includes primarily a plastic cover B and a plastic seat C which are up-down symmetric, whereas a bottom surface of the plastic cover B is formed with plural lower grooves B1 and a top surface of the plastic seat C is formed with plural upper grooves C1, such that plural heating pipes D can be accommodated between each upper and lower groove B1, C1. Then, the plastic cover B and the plastic seat C are attached together, and when water in each heating pipe D is heated up to produce heat, the heat can be conducted upward through the plastic cover B, so as to achieve a heating effect. Nevertheless, when the heating pipes D are heated up, as the plastic cover B is provided with a considerable thickness, the heat conduction efficiency is not very perfect, which will excessively consume electricity.

SUMMARY OF THE INVENTION

The primary object of the present invention is to provide a toilet seat heating device, wherein an upper surface of a base plate, which is provided with a carbon fiber on the hotline, is orderly assembled with a cooling fin and an upper seat, such that when the carbon fiber on the hotline is energized, the cooling fin can quickly absorb heat energy of the carbon fiber on the hotline and then conduct the heat energy upward to the upper seat, with that the heat can be conducted quickly and temperature of heat transfer can be distributed uniformly.

Another object of the present invention is to provide a toilet seat heating device, wherein a soft carbon fiber on the hotline, which can be bended freely, is directly installed in a groove of an upper surface of the base plate, so as to save a cost of processing.

To achieve the aforementioned objects, a technical means used by the present invention is that a toilet seat heating device is provided with a base plate having a carbon fiber on the hotline, an upper seat and a cooling fin which is installed between the base plate and the upper seat. An upper side of the said base plate is provided with an annular groove and the carbon fiber on the hotline is provided in the annular groove to contact with the cooling fin. Accordingly, the cooling fin can quickly absorb the heat energy of the carbon fiber on the hotline and then conduct the heat energy upward to the upper seat.

In the aforementioned toilet seat heating device, the said cooling fin is a metal foil.

In the aforementioned toilet seat heating device, an upper side of the said base plate is a plane which is provided with the annular groove, a rectangular groove and a straight groove. The said annular groove is in an annular shape along the plane of the base plate, the said rectangular groove is provided at a rear side of the plane and is connected with the annular groove, and the said straight groove is extended from an end of the base plate to the rectangular groove.

In the aforementioned toilet seat heating device, the said carbon fiber on the hotline is a flexible carbon carbon fiber on the hotline or a nickel-chromium resistance wire; as the flexible carbon carbon fiber on the hotline is provided with better flexibility, the preferred choice is the flexible carbon carbon fiber on the hotline.

In the aforementioned toilet seat heating device, the said flexible carbon carbon fiber on the hotline is constituted by a heating unit and an insulative sleeve which encloses an exterior side of the heating unit. The said heating unit is a carbon fiber bundle and the said insulative sleeve can be a flexible heat-resistant tube or a braided tube. The said heat-resistant tube can be a fluoroelastomer tube, a silicon tube, a PU (polyurethane) tube, a PVC (polyvinylchloride) tube, a PE (polyethylene) tube, a PP (polypropylene) tube, a PET (polyester) tube, a Nylon (or polyamide) tube or a PI (polyimide) tube; whereas the said braided tube can be assembled by one or more than one fiber bundle among a glass fiber bundle, a rock fiber bundle, a ceramic fiber bundle and a Kevlar® fiber bundle. In addition to insulating electricity, the said insulative sleeve can also protect the carbon fiber bundle from being scratched and broken. The heat-resistant tube is provided with a better water proof-property but a larger heat loss; whereas, the braided tube is provided with gaps that heat can be dissipated easily to have a heat adjustment function, therefore, the heat loss is smaller but the water-proof property is inferior. As the carbon fiber on the hotline of the present invention is provided between the base plate and the upper seat of a double-layered structure, the carbon fiber on the hotline is provided with the water-proof property and thus it is preferred to choose the braided tube.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
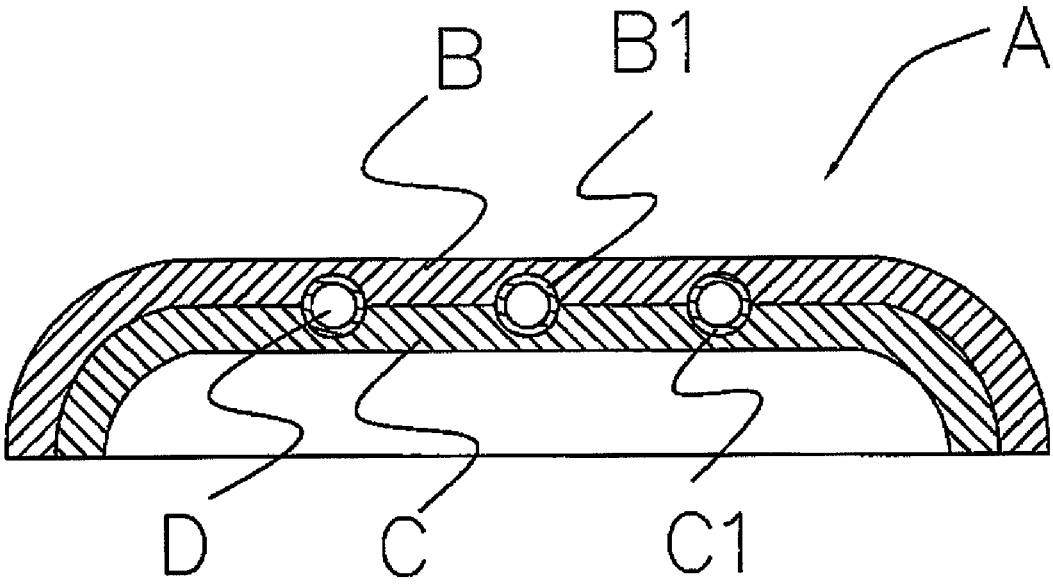
FIG.1 Prior Art
FIG. 1 shows a cutaway view of a conventional toilet seat.
Figure 2:
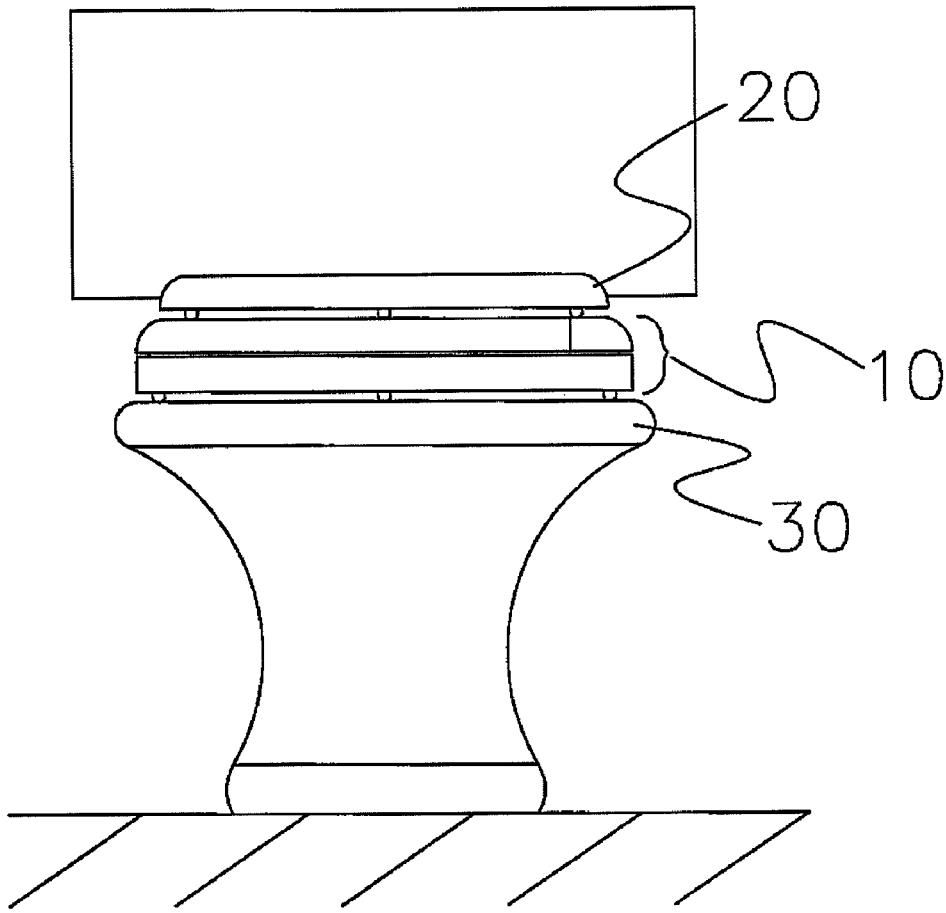
FIG. 2 shows a schematic view of an assembly state of the present invention.
Figure 3:
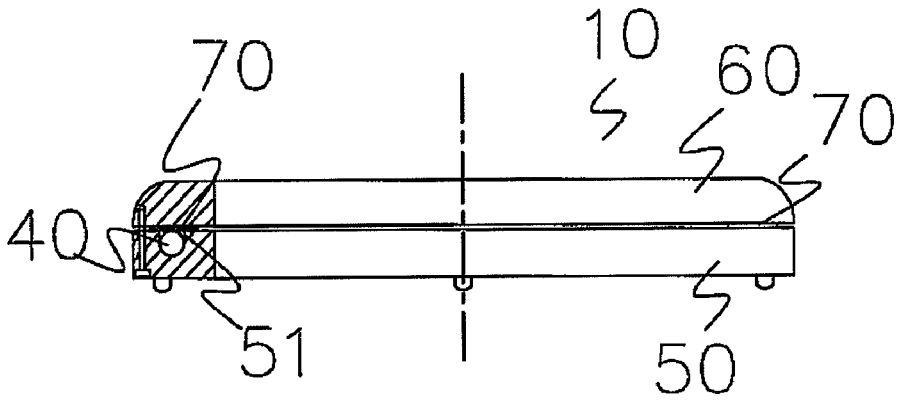
FIG. 3 shows a cutaway view of a toilet seat of the present invention.

Referring to FIG. 2 and FIG. 3, the present invention discloses a toilet seat heating device 10 which is provided between a toilet cover 20 and a bowl 30, wherein the said heating device 10 comprises a base plate 50 which is provided with a carbon fiber on the hotline 40, an upper seat 60 and a cooling fin 70 which is provided between the base plate 50 and the upper seat 60.

Figure 4:
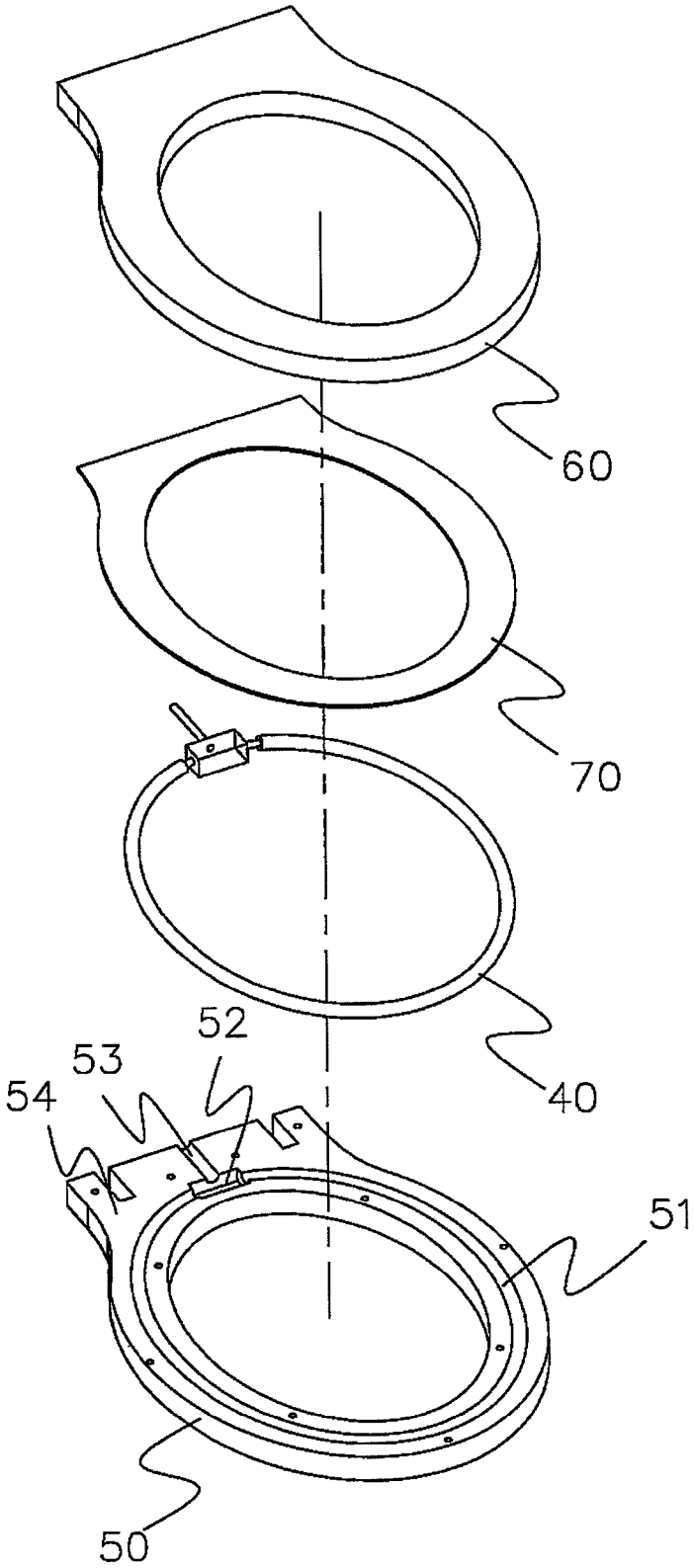
FIG. 4 shows a three-dimensional exploded view of the toilet seat of the present invention.

As shown in FIG. 4, an upper side of the said base plate 50 is a plane 54 which is provided with an annular groove 51, a rectangular groove 52 and a straight groove 53, wherein the annular groove 51 is in an annular shape along the plane 54 of the base plate 50, the said rectangular groove 52 is provided at a rear side of the plane 54 and is connected with the annular groove 51, whereas the straight groove 53 is extended from an end of the base plate 50 to the rectangular groove 52.

Figure 5:
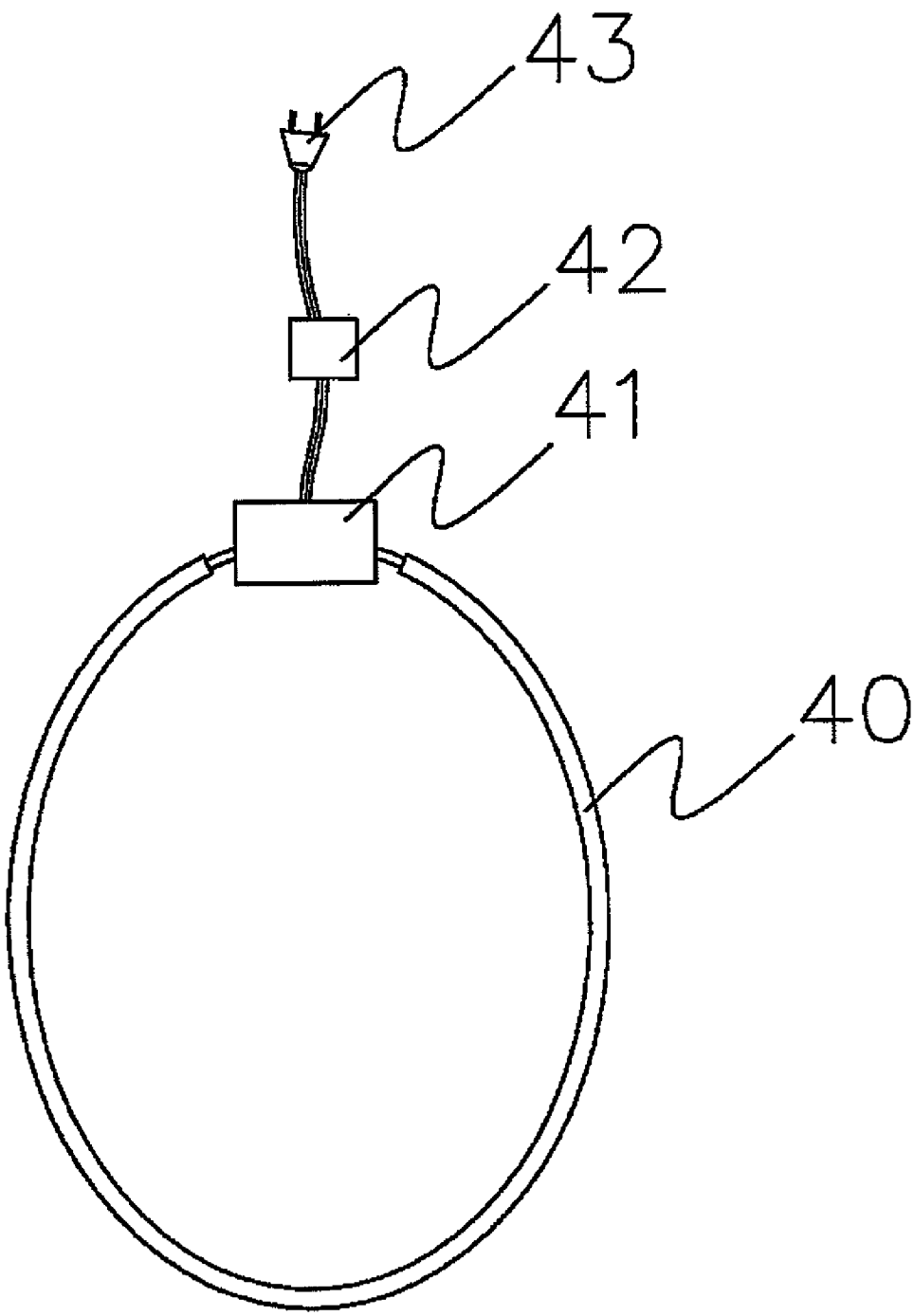
FIG. 5 shows a schematic view of a carbon fiber on the hotline of the present invention.

As shown in FIG. 5, a front end of the said carbon fiber on the hotline 40 is orderly connected with a thermostat 41, a transformer 42 and a power plug 43, wherein the said thermostat 41 is to control heating temperature of the carbon fiber on the hotline 40, and the said transformer 42 is to provide a safe voltage. As shown in FIG. 4, the said carbon fiber on the hotline 40 is provided in the annular groove 51 on the plane 54 above the base plate 50, the said thermostat 41 is provided in the rectangular groove 52 and the said carbon fiber on the hotline 40 can be a flexible carbon carbon fiber on the hotline or a nickel-chromium resistance wire, preferably the flexible carbon carbon fiber on the hotline as the flexible carbon carbon fiber on the hotline is provided with better flexibility.

Figure 6:
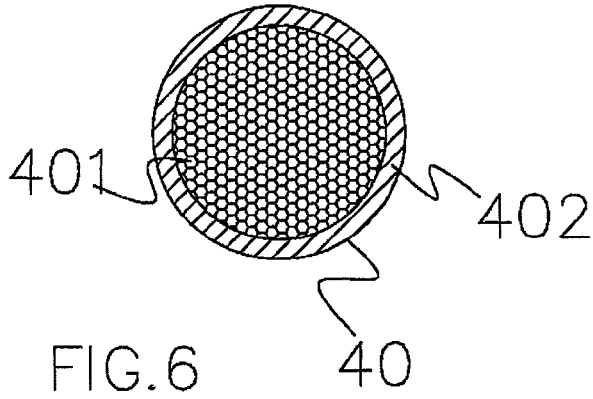
FIG. 6 shows a cross sectional view of an insulative heat-resistant tube outside the carbon fiber on the hotline of the present invention.
Figure 7:
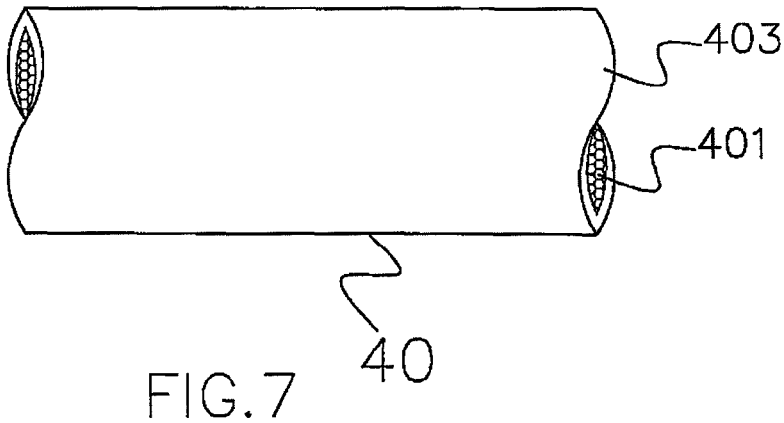
FIG. 7 shows a cutaway view of a heat-resistant tube outside the carbon fiber on the hotline of the present invention.
Figure 8:
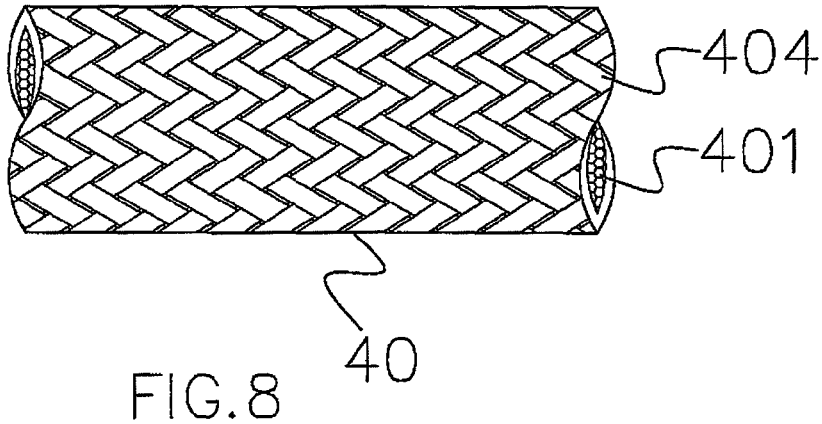
FIG. 8 shows a schematic view of a braided tube outside the carbon fiber on the hotline of the present invention.

Referring to FIG. 6, FIG. 7 and FIG. 8, the said flexible carbon carbon fiber on the hotline 40 is primarily constituted by a heating unit 401 and an insulative sleeve 402 which encloses an exterior side of the heating unit 401. The said heating unit 401 is a carbon fiber bundle and the said insulative sleeve 402 can be a flexible heat-resistant tube 403 or a braided tube 404. Referring to FIG. 7 and FIG. 8, FIG. 7 shows a cutaway view of the heat-resistant tube 403 and FIG. 8 shows a schematic view of the braided tube 404. The said heat-resistant tube 403 can be a fluoroelastomer tube, a silicon tube, a PU tube, a PVC tube, a PE tube, a PP tube, a PET tube, a Nylon tube or a PI tube; whereas the said braided tube 404 can be assembled by one or more than one fiber bundle among a glass fiber bundle, a rock fiber bundle, a ceramic fiber bundle and a Kevlar® fiber bundle.

In FIG. 4, the said cooling fin 70 is a metal foil, such as an aluminum foil or a copper foil, preferably the aluminum foil. The cooling fin 70 is in an annular shape along the base plate 50 and is in contact with the carbon fiber on the hotline 40 in the annular groove 51 on the plane 54 to absorb the heat energy of the carbon fiber on the hotline 40. A bottom of the said upper seat 60 is a plane and the upper seat 60 is fixed at a top of the base plate 50 with a screwing element (not shown in the drawings), allowing the cooling fin 70 to be attached and fixed between the base plate 50 and the upper seat 60, such that the cooling fin 70 can quickly absorb the heat energy of the carbon fiber on the hotline 40 and rapidly conduct the heat energy to the upper seat 60, thereby acting as a warm and comfortable toilet seat.

Accordingly, the present invention is provided with following advantages:

1. When the carbon fiber on the hotline is energized, the heat energy of the carbon fiber on the hotline can be quickly diffused on the cooling fin and then quickly conducted upward to the upper seat; the heat can be transferred quickly and temperature can be distributed uniformly.
2. The structures of the present invention are simple and this facilitates processing to save a cost.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A toilet seat heating device comprising a base plate which is provided with a carbon fiber on a hotline, an upper seat and a cooling fin which is provided between the base plate and the upper seat, wherein an upper side of the base plate is provided with an annular groove, and the carbon fiber on the hotline is installed in the annular groove to contact with the cooling fin, allowing the cooling fin to quickly absorb heat energy of the carbon fiber on the hotline and then to conduct the heat energy upward to the upper seat, an upper side of the base plate is a plane which is provided with the annular groove a rectangular groove and a straight groove, with the annular groove being in an annular shape along the plane of the base plate, the rectangular groove being provided at a rear side of the plane to connect with the annular groove and the straight groove being extended from an end of the base plate to the rectangular groove.

2. The toilet seat heating device according to claim 1, wherein the cooling fin is a metal foil.

3. The toilet seat heating device according to claim 1, wherein the carbon fiber on the hotline is flexible carbon carbon fiber which is further provided with a heating unit and an insulative sleeve which encloses an exterior side of the heating unit.

4. The toilet seat heating device according to claim 3, wherein the heating unit is a carbon fiber bundle.

5. The toilet seat heating device according to claim 3, wherein the insulative sleeve is a flexible heat-resistant tube or a braided tube.

6. The toilet seat heating device according to claim 5, wherein the flexible heat-resistant tube is a fluoroelastomer tube, a silicon tube, a PU (polyurethane) tube, a PVC (polyvinylchloride) tube, a PE (polyethylene) tube, a PP (polypropylene) tube, a PET (polyester) tube, a Nylon tube and a PI (polyimide) tube.

7. The toilet seat heating device according to claim 5, wherein the braided tube is assembled by one or more than one fiber bundle among a glass fiber bundle, a rock fiber bundle, a ceramic fiber bundle and a Kevlar® fiber bundle.

8. The toilet seat heating device according to claim 2, wherein the metal foil is an aluminum foil.

* * * * *